US005858597A

United States Patent [19]

Mizoh et al.

[11] Patent Number: 5,858,597

[45] Date of Patent: Jan. 12, 1999

[54] TONER FOR DEVELOPING ELECTROSTATIC IMAGE CONTAINING SPECIFIED DOUBLE OXIDE PARTICLES

[75] Inventors: Yuichi Mizoh, Toride; Takaaki Kohtaki, Yokohama; Yushi Mikuriya; Tadashi Doujo, both of Kawasaki, all of Japan

[73] Assignee: Canon Kabushiki Kaisha, Tokyo, Japan

[21] Appl. No.: 697,877

[22] Filed: Aug. 30, 1996

[30] Foreign Application Priority Data

Sep. 4, 1995 [JP] Japan ..... 7-248336
Sep. 4, 1995 [JP] Japan ..... 7-248337

[51] Int. Cl.[6] ..... G03G 9/097

[52] U.S. Cl. ..... 430/110; 524/443; 524/456

[58] Field of Search ..... 430/110; 524/443, 524/456

[56] References Cited

U.S. PATENT DOCUMENTS

| | | | |
|---|---|---|---|
| 2,297,691 | 10/1942 | Carlson | 95/5 |
| 3,300,443 | 1/1967 | Ciceri et al. | 524/443 |
| 3,666,363 | 5/1972 | Tanaka et al. | 355/17 |
| 4,071,361 | 1/1978 | Marushima | 96/1.4 |
| 4,626,487 | 12/1986 | Mitsuhashi et al. | 430/109 |
| 4,702,986 | 10/1987 | Imai et al. | 430/120 |
| 4,741,984 | 5/1988 | Imai et al. | 430/106.6 |
| 4,824,752 | 4/1989 | Yasuda et al. | 430/106.6 |
| 5,153,657 | 10/1992 | Yu et al. | 355/299 |
| 5,340,678 | 8/1994 | Suzuki et al. | 430/110 |
| 5,348,829 | 9/1994 | Uchiyama et al. | 430/106.6 |
| 5,354,637 | 10/1994 | Shimamura et al. | 430/106.6 |
| 5,406,357 | 4/1995 | Nakahara et al. | 355/245 |
| 5,547,796 | 8/1996 | Kohtaki et al. | 430/106.6 |

FOREIGN PATENT DOCUMENTS

| | | |
|---|---|---|
| 58-66951 | 9/1983 | Japan . |
| 59-168458 | 9/1984 | Japan . |
| 59-168459 | 9/1984 | Japan . |
| 59-168460 | 9/1984 | Japan . |
| 59-170847 | 9/1984 | Japan . |
| 60-32060 | 2/1985 | Japan . |
| 61-236559 | 10/1986 | Japan . |
| 63-2073 | 1/1988 | Japan . |
| 2-110475 | 4/1990 | Japan . |
| 5-333590 | 12/1993 | Japan . |
| 7-179702 | 7/1995 | Japan . |

OTHER PUBLICATIONS

Chemical Abstracts 123:342253, 1995.

Grant, Roger and Claire Grant. Grant and Hackh's Chemical Dictionary. New York: McGraw–Hill, Inc. pp. 439, 557, 639, 1987.

*Primary Examiner*—Christopher D. Rodee

*Attorney, Agent, or Firm*—Fitzpatrick, Cella, Harper & Scinto

[57] ABSTRACT

A toner for developing an electrostatic image is constituted by toner particles containing at least a binder resin and a colorant, and particles containing at least one double oxide. The double oxide includes a double oxide (A) represented by the following formula (1):

$$M_aSi_bO_c \quad (1),$$

wherein M denotes a metallic element selected from the group consisting of Sr, Mg, Zn, Co, Mn and Ce; a is an integer of 1–9; b is an integer of 1–9; and c is an integer of 3–9. The above particles including a double oxide (A) are effective in improving flowability and triboelectric chargeability of the toner and providing a resultant image with excellent image qualities.

28 Claims, 4 Drawing Sheets

TONER FOR DEVELOPING ELECTROSTATIC IMAGE CONTAINING SPECIFIED DOUBLE OXIDE PARTICLES

FIELD OF THE INVENTION AND RELATED ART

The present invention relates to a toner for developing electrostatic images in image forming methods, such as electrophotography and electrostatic printing.

Hitherto, a large number of electro-photographic processes have been known, as disclosed in U.S. Pat. Nos. 2,297,691; 3,666.,363; 4,071,361 and others. In these processes, an electrostatic latent image is formed on a photosensitive member comprising a photoconductive material by various means, then the latent image is developed and visualized with a toner, and the resultant toner image is, after transferred onto a transfer(-receiving) material such as paper etc., as desired, fixed by heating, pressing, or heating and pressing, or with solvent vapor to obtain a toner image.

Accompanying development of digital copying machines and reduction in size of toner particles in recent years, it has been desired to develop copying machines having multiplicity of functions, capable of providing high-quality copy images, and having a shorter first copy time through an improvement in a fixing system in view of energy saving as measures against environmental problems.

However, the development of a toner of a smaller particle size for improving resolution and clarity of images and reduction of a first copy time results in new problems accompanying it.

More specifically, a smaller toner particle size leads to an increase in surface area of toner particles per unit weight, whereby the toner chargeability is more liable to be affected by the environment. Particularly, in case where such toner particles are left standing in a high-temperature and high-humidity environment for a long period, the toner particles are susceptible to moisture, thus being liable to result in a lowering in image density after the standing.

A recent digital copying machine is even required to provide a combination of a character image which is clear and a photographic image which faithfully reproduces the density gradation of the original. As a general tendency in a copy of a photographic image with characters, an increase in line image density for providing clearer characters not only impairs the density gradation characteristic of the photographic image but results in remarkable roughness in the halftone portion. On the other hand, in the case of improving the density gradation characteristic of the photographic image the line density of the character image is lowered and the clarity of the character image is impaired.

In recent years, it has become possible to provide an image with improved density gradation to some extent by reading the image density at respective portions of an image and digitally converting the read density data, but a further improvement is desired at present.

Such further improvements largely depend on improvements in developing characteristics of a developer. Image densities do not usually satisfy a linear relationship with developing potentials (differences between potentials of a photosensitive member and a developer-carrying member) but show a tendency of projecting downwardly at low developing potentials and projecting upwardly at higher developing potentials as indicated by a solid curve in FIG. 3. Accordingly, in a halftone region, the image density varies greatly corresponding to a slight change in developing potential. As a result, it is difficult to provide a good density gradation characteristic.

In order to obtain a clear copy of a line image, it is practically sufficient to have a maximum density on the order of 1.30 at a solid image part not readily affected by an edge effect as the contrast of a line image is generally enhanced by the edge effect.

In a photographic image, however, an original image per se has a very large maximum density of 1.90–2.00 while the impression thereof is largely affected by a surface gloss. Accordingly, in a copy of such a photographic image having a generally large area and not causing a density increase owing to the edge effect, it is necessary to retain a maximum image density of about 1.4–1.5 at a solid image part even if the surface gloss is suppressed.

Accordingly, in copying a photographic image with characters, it is very important to satisfy a linear relationship between the developing potential and the image density and retain a maximum image density of 1.4–1.5.

For the above purpose, it is critical to control the toner chargeability as uniformly as possible. Further, it is also particularly critical to prevent possible lowerings in toner chargeability and toner flowability in a high-temperature/high-humidity environment in view of structural demands for the copying machine at present.

As methods of stabilizing the toner charge, Japanese Laid-Open Patent Application (JP-A) 58-66951, JP-A 59-168458 to JP-A 59-168460 and JP-A 59-170847 have proposed the use of electroconductive zinc oxide and tin oxide.

JP-A 60-32060 has proposed a method wherein two kinds of inorganic fine powder are used to remove paper dust and ozone adduct formed on or attached to the surface of a photosensitive member.

JP-A 2-110475 has proposed a method wherein two kinds of inorganic fine powder are used in combination with a toner comprising styrene-acrylic resin crosslinked with a metal to remove paper dust and ozone adduct formed on or attached to the surface of a photosensitive member, and alleviate toner scattering, image flow and image density decrease in a high temperature—high humidity environment.

JP-A 61-236559 and JP-A 63-2073 have disclosed methods wherein cerium oxide particles are used to improve the toner chargeability. According to this method, the toner chargeability can be surely increased but, when an organic photosensitive member is used, the surface layer of the photosensitive member can be gradually abraded due to an abrasive effect of the cerium oxide, thus resulting in inferior copy images.

Accordingly, accompanying the development of a smaller particle size toner, a toner capable of being uniformly charged and retaining its chargeability even if the toner is left standing for a long time in a high temperature—high humidity environment is still desired.

SUMMARY OF THE INVENTION

An object of the present invention is to provide a toner for developing electrostatic images which has solved the above-mentioned problems.

Another object of the present invention is to provide a toner for developing electrostatic images capable of providing copy images having a high image density from at an initial stage to after standing for a long time even in a high temperature—high humidity environment.

Another object of the present invention is to provide a toner for developing electrostatic images capable of suppressing occurrence of fogs at a non-image portion.

Another object of the present invention is to provide a toner for developing electrostatic images which can be uniformly applied on a developer-carrying member and includes toner particles being efficiently triboelectrically charged uniformly.

Another object of the present invention is to provide a toner for developing electrostatic images which is excellent in successive copying characteristic with respect to copying of a large number of sheets.

According to the present invention there is provided a toner for developing an electrostatic image, comprising:

toner particles comprising at least a binder resin and a colorant and particles comprising a double oxide (A) represented by the following formula (1):

$$M_aSi_bO_c \quad (1),$$

wherein M denotes a metallic element selected from the group consisting of Sr, Mg, Zn, Co, Mn and Ce; a is an integer of 1–9; b is an integer of 1–9; and c is an integer of 3–9.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
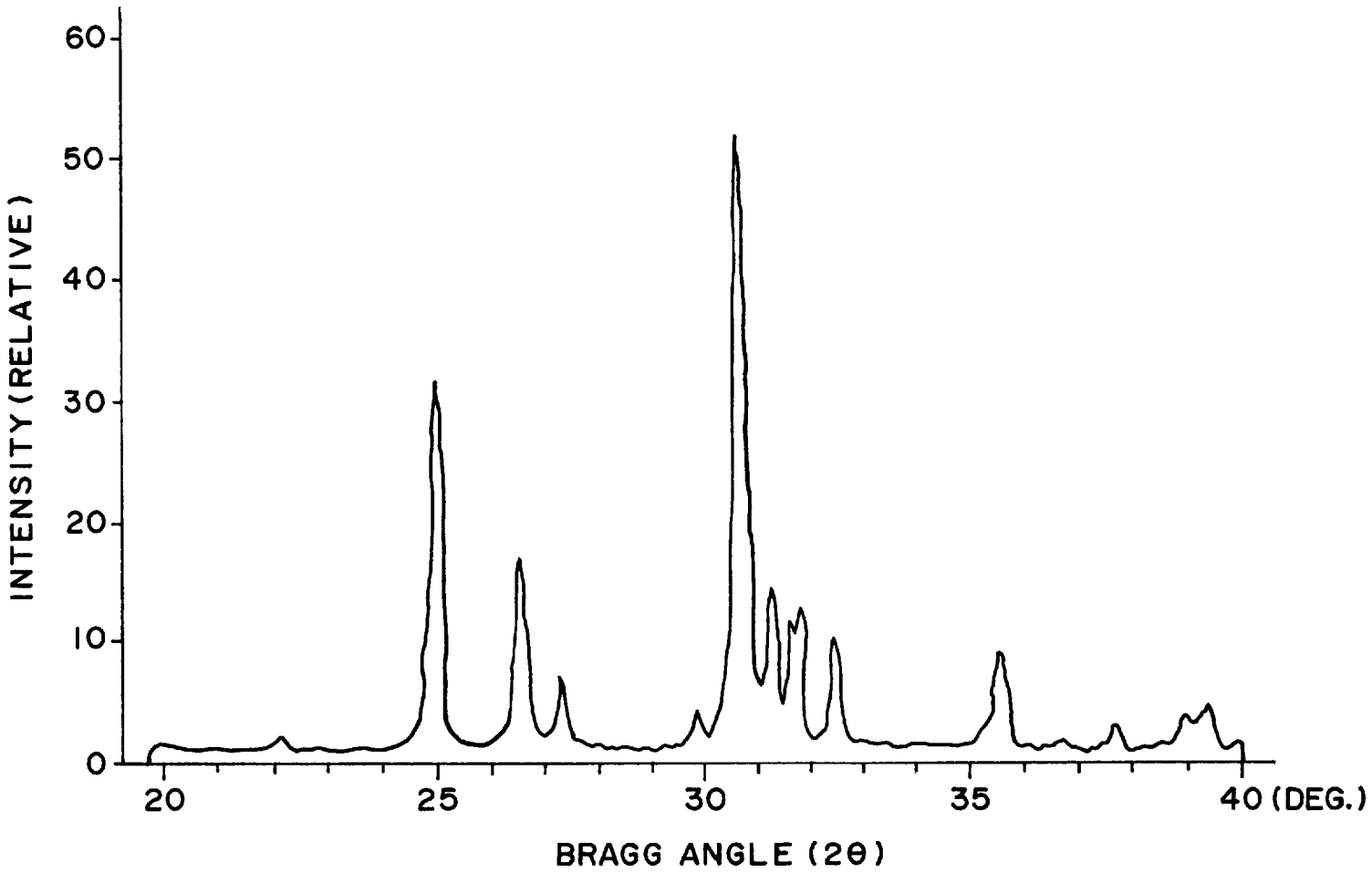
FIG. 1 is a graph showing an X-ray diffraction pattern of particles comprising strontium silicate produced in Production Example 1 appearing hereinafter.

There is generally a charge distribution with respect to the toner chargeability. The charge distribution of a one-component type developer is affected by the dispersion state of materials (e.g., a magnetic material, a colorant, etc.) constituting the toner and the toner particle size distribution. In case where the toner-constituting materials are uniformly dispersed in respective toner particles, the charge distribution is principally affected by the toner particle size distribution. A small-particle size toner generally has a large charge, and a large particle size toner generally has a small charge. A toner having a larger charge generally has a broader charge distribution, and vice versa.

In order to stabilize the toner chargeability, there is known a method of attaching electroconductive powder to the toner to lower the charge as described above. According to this method, however, a sufficiently high maximum image density is not obtained and a deterioration in image quality in successive copying cannot be satisfactorily suppressed. We have considered the reason as follows.

In the method of attaching electroconductive powder to a toner to lower the charge, electroconductive powder is preferentially attached to smaller particle size (per unit weight) toner (i.e., a toner having a large chargeability) according to electrostatic force, whereby white background fog can be alleviated.

However, small toner particles (to which electroconductive powder having a large effect of lowering the toner charge is attached) are preferentially consumed for development. In case where such a small particle size toner is fixed, the small toner particles can cover only a smaller area of a fixation-supporting material, such as transfer paper, than larger toner particles so that the maximum image density obtained thereby is lower than that obtained by larger toner particles.

Further, small toner particles are preferentially consumed for development, so that the image quality is good at the initial stage but becomes inferior, as represented by roughening, in successive copying due to the increase in toner particle size in the developer container.

Contrary with reduction of the charge of the toner as in the above method, a method of triboelectrically charging a toner fraction by contact of the toner with a metal oxide within a developer container can surely allow increase and uniformization in toner chargeability.

However, it becomes difficult to quickly charge the toner so as to have a prescribed charge within the developer container in a shorter waiting time by using this method in the case of a shorter first copy time required for an apparatus body of the copying machine. Particularly, this is not satisfactory in a high temperature—high humidity environment. This may be attributable to a lowering in flowability of a toner accompanying a small particle size toner, particularly lowerings in flowability and chargeability in a high temperature—high humidity environment due to moisture absorption (hygroscopicity) of the toner.

In a conventional copying machine, a hot fixation roller is employed as a fixation system, so that it is possible to impart a toner to a flowability and chargeability to some extent by stirring and mixing the toner within a developer container in a time up to a start of first copying operation, i.e., a time (heat-up time) from connection of power to the copying machine until the fixation roller is warmed up to a prescribed fixation temperature. However, in recent years, an improvement in a fixation system is advanced whereby a heat-up time is reduced and becomes zero with respect to a so-called surf fixation system (or film fixation system).

In such a surf fixation system, the above-described stirring (and mixing) of the toner cannot be performed satisfactorily, thus failing to impart the toner to a flowability and chargeability. As a result, resultant copy images are liable to have a lower image density and be accompanied with fogs.

JP-A 5-333590 filed by our research group has proposed a toner containing metal oxide powder. Metal oxide powder having a substantial particle size relative to a certain particle size of toner frequently repeats attachment to the toner and separation from the toner due to a shearing force within the developer container, thus reversely increasing the charge of a rather large toner fraction.

However, the metal oxide powder is liable to lower a toner flowability. Accordingly, as described above, particularly in the case of using the surf fixation system, fully satisfactory copy images are not readily obtained in a high temperature—high humidity environment.

In this respect, we have directed our attention to the following points (a) and (b).

(a) A flowability-improving agent (flowability improver) not only attains an improvement in flowability of a toner but also improves developing performances. This is presumably because a generally known flowability improver (e.g., fluorinated compound, $SiO_2$, surface-treated $SiO_2$, etc.) has a polarity, so that the flowability improver affects charging characteristics of the toner. From a viewpoint of image density, a large addition amount is generally advantageous to the flowability improver. However, if an excessive amount of the flowability improver is used, a state of the flowability improver attached to the toner particle surface is liable to be changed and accordingly, it is difficult to retain uniform triboelectrification among the toner particles, thus being liable to result in an occurrence of fogs. For this reason, by only effecting an increase in addition amount of the flowability improver, the above-mentioned requirements for the toner cannot be met satisfactorily.

(b) It is possible to improve a flowability of double oxide particles per se by blending double oxide particles with a flowability improver in advance of blending with toner particles. In addition by using the double oxide particles, a lowering in flowability of a toner in a high temperature—high humidity environment can be prevented. However, in this case, the double oxide particles are lowered in its charge-imparting ability, per se, as an original function, resulting from triboelectric charging with the toner particle, so that difficulties such a lowering in image density and an occurrence of fogs are liable to arise. This is presumably because charge transfer occurs between the flowability improver and the double oxide particles in addition to triboelectric charging originally effected between the toner particles and the double oxide particles, so that a charge of the entire toner is reduced compared with the case of not adding the double oxide particles. Consequently, the toner is liable to be lowered in developing performances, image density and cause fogs. For this reason, the above-mentioned requirements for the toner cannot be satisfactorily met by only adding the flowability improver to the double oxide particles.

Accordingly, based on a concept that triboelectric charging of toner particles with double oxide particles provides a larger charge without impairing a toner flowability, we have investigated various double oxide particles.

As a result, we have found that it is possible to improve a flowability of a toner and provide the toner with a large triboelectric charge by using double oxide particles containing silicon (Si) in a triboelectric charging between toner particles and the double oxide particles within a developer container, thus attaining a high image density even in a severe high temperature—high humidity environment.

By incorporating Si element in double oxide particles, a resultant toner has a flowability better than that in the case of incorporating another element since Si element is considered to be excellent in flowability in view of the fact that silica is generally used as a flowability improver. Further, certain Si-containing double oxide particles exhibits a high charge-imparting ability in triboelectric charging with toner particles thus increasing a charge (chargeability) of a resultant toner. For this reason, the Si-containing double oxide particles can provide the toner particles with a charge sufficient to provide a satisfactory developing characteristic even in the case of less contact with the toner particles while suppressing a lowering in toner flowability.

As described above, we have found that, in order to provide a sufficient developing characteristic even in a high temperature—high humidity environment, particularly to provide a high image density after being left standing in such an environment, it is important to use particles comprising a double oxide (A), represented by the formula (1) shown below, capable of preventing a lowering in toner flowability resulting from moisture absorption thereof and exhibiting a large charge-imparting ability in the triboelectric charging.

$$M_aSi_bO_c \quad (1),$$

wherein M denotes a metallic element selected from the group consisting of Sr, Mg, Zn, Co, Mn and Ce, preferably be Sr; a is an integer of 1–9; b is an integer of 1–9; and c is an integer of 3–9 .

Figure 3:
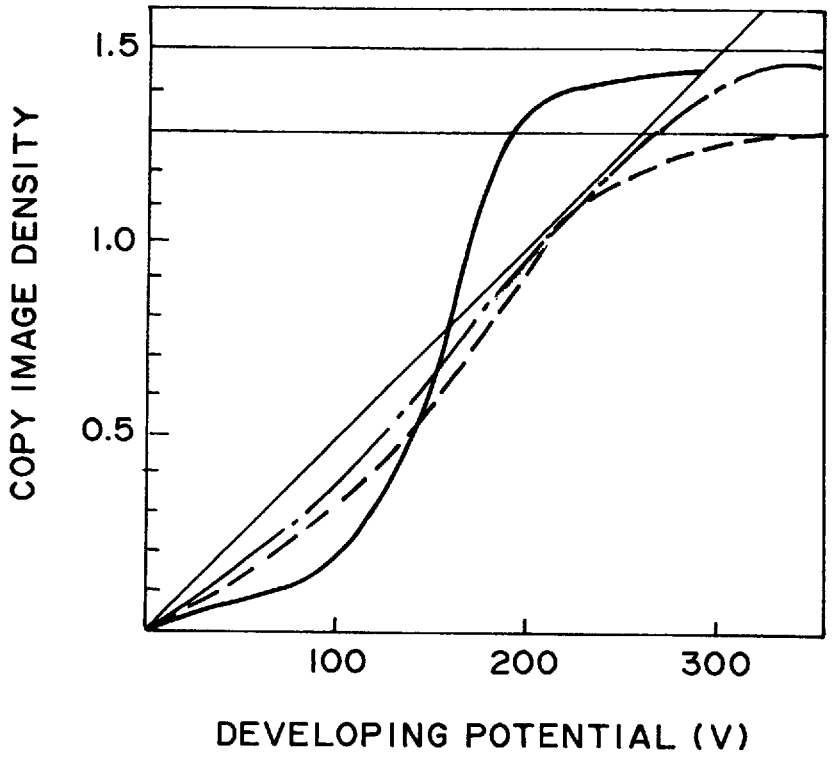
FIG. 3 is a graph showing relationship between copy image density and developing potential, wherein a solid curve represents a case wherein the maximum image density is set to 1.4 or higher, a broken line represents a case wherein a condition is set to provide a good density gradation, and an alternate long and short dash line represents a case wherein a toner according to the present invention is used.

In this connection, referring to FIG. 3, the alternate long and short dash line represents a relationship between developing potential and copy image density obtained by using a toner containing the particles comprising the double oxide (A) of the above formula (1) according to the present invention.

In the above formula (1), a may preferably be 1–3, b may preferably be 1 or 2, and c may preferably be 3–7.

Further, from a viewpoint of stoichiometry, a, b and c in the formula (1) satisfy the following relationship of na+4b= 2c wherein n represents a valence of the metallic element (M).

In the present invention, the double oxide (A) of the above formula (1) may preferably comprise strontium silicate ($Sr_aSi_bO_c$) since it can more effectively bring about the above-described advantageous effects. Specific examples of strontium silicate may include $SrSiO_3$, $Sr_3SiO_5$, $Sr_2SiO_4$, $SrSi_2O_5$ and $Sr_3Si_2O_7$. Among these, $SrSiO_3$ may preferably be used.

From a similar viewpoint, a ratio between the metallic element (M) and Si (i.e., a/b) in the formula (1) may preferably be 1/9–9.0, more preferably 0.5–3.0.

The particles comprising the double oxide (A) used in the present invention may preferably be produced by sintering (process), followed by mechanical pulverization and pneumatic classification to adjust so as to have a desired particle size distribution.

The resultant particles comprising the double oxide (A) may include those comprising at least one species of the double oxide (A) represented by the above formula (1). In case where the particles comprises two or more species of the double oxide (A) are used, such particles comprising two or more species of the double oxide (A) may preferably be produced at the same time by sintering but may be prepared by simply mixing them each obtained by sintering separately with each other.

The particles comprising the double oxide (A) may preferably be used (externally added) in an amount of 0.05–15 wt. parts, more preferably 0.1–5.0 wt. parts, per 100 wt. parts of toner particles, and may preferably have a weight-average particle size ($D_4$) of 0.5–5 $\mu$m, which may desirably be smaller than that of the toner particles.

In a further preferred embodiment of the present invention, the particles comprising the above-described double oxide (A) of the formula (1) further comprises a double oxide (B) represented by the following formula (2):

$$M^2_dTi_eO_f \quad (2),$$

wherein $M^2$ denotes a metallic element selected from the group consisting of Sr, Mg, Zn, Co, Mn and Ce; d is an integer of 1–9; e is an integer of 1–9; and f is an integer of 3–9.

The toner according to the present invention is effective in providing a high image density while suppressing an image flow (image dropout) or a lowering in image quality during successive image formation through removal of matter attached to and remaining on the surface of a photosensitive drum even in a severe high temperature—high humidity environment by using the double oxide (B) containing Ti element for achieving an abrasive effect in combination with the double oxide (A) containing Si element for improving a toner flowability and a triboelectric charge characteristic. Thus, the abrasive effect and flowability of the toner can be improved by using the double oxide (A) containing Si element and the double oxide (B) containing Ti element in combination.

As the double oxide (A) containing Si element has a small abrasive effect, a resultant toner has little effect with respect to removal of matter attached to a photosensitive drum of a (drum) heaterless system. Such an abrasive effect is compensated or supplemented by using the double oxide (B) containing Ti element, so that we have found that a resultant toner is capable of meeting recent demands for a drum heaterless system as a mode of a copying machine and a reduction of first copy time.

As described above, in the present invention, it is preferred to use the double oxide (B) not only having a sufficient abrasive effect without being adversely affected by growing matter attached to the photosensitive drum even in a copying machine system free from a drum heater therein and in a high temperature—high humidity environment but also not marring the drum surface and to use the double oxide (A) capable of preventing a lowering in toner flowability resulting from e.g., moisture absorption for providing a sufficient developing characteristic, particularly a high image density, and capable of exhibiting a high charge-imparting ability at the same time.

The double oxide (B) of the formula (2) described above may preferably comprise strontium titanate (particularly $SrTiO_3$) in order to effectively bring about the above-described effects. The double oxide (B) may preferably has a ratio between the metallic element ($M^2$) and Ti (i.e., d/e) in the formula (2) of 1/9–9.0, more preferably 0.5–3.0.

From a similar viewpoint, the double oxide (A) and the double oxide (B) may preferably provide a mixing ratio ((A)/(B)) by mole of 0.05–19.0, more preferably 0.25–1.5.

The particles comprising the double oxide (A) and the double oxide (B) used in the present invention may preferably be produced by sintering (process), followed by mechanical pulverization and penumatic classification to adjust so as to have a desired particle size distribution. In the sintering process the double oxides (A) and (B) may preferably be produced at the same time. Further, the particles comprising the double oxides (A) and (B) may be prepared by mixing particles of the double oxide (A) produced by sintering with those of the double oxide (B) produced by sintering separately from the double oxide (A), followed by pulverization and classification in the same manner as in the above case.

The particles comprising the double oxide (A) and the double oxide (B) may preferably be used (externally added) in an amount of 0.05–15 wt. parts, more preferably 0.1–5.0 wt. parts., per 100 wt. parts of toner particles, and may preferably have a weight-average particle size ($D_4$) of 0.5–5 $\mu$m, which may desirably be smaller than that of the toner particles.

The binder resin used in the present invention may for example include vinyl resins, polyester resins and epoxy resins. Among these, vinyl resins and polyester resins are preferred in view of chargeability and fixability.

Examples of vinyl monomers to be used for providing a vinyl resin (copolymer) constituting the binder resin of the present invention may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-noctylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; the esters of the above-mentioned $\alpha,\beta$-unsaturated acids and the diesters of the above-mentioned dibasic acids. These vinyl monomers may be used singly or in combination of two or more species.

Among these, a combination of monomers providing styrene-type copolymers and styrene-acrylic (or methacrylic) type copolymers may be particularly preferred.

The binder resin used in the present invention may include a crosslinking structure obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene 20 glycol #600 diacrylate, dipropylene glycol diacrylate and compounds obtained by substituting methacrylate groups for the acrylate groups in the above compounds;

diacrylate compounds connected with a chain including an aromatic group and an ether bond, such as polyoxyethylene(2)-2,2-bis(4-hydroxyphenyl) propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds such as one known by a trade name of MANDA (available from Nihon Kayaku K. K.). Polyfunctional crosslinking agents such as pentaerythritol triacrylate, trimethylolethane triacrylate, trimethylolpropane triacrylate, tetramethylolmethane tetracrylate, oligoester acrylate, and compounds obtained by substituting methacrylate groups for the acrylate groups in the above compounds, triallyl cyanurate and triallyl trimellitate.

These crosslinking agents may preferably be used in a proportion of 0.01–5 wt. parts, particularly 0.03–3 wt. parts, per 100 wt. parts of the other vinyl monomer components.

Among the above-mentioned crosslinking monomers, aromatic divinyl compounds (particularly, divinylbenzene) and diacrylate compounds connected with a chain including an aromatic group and an ether bond may suitably be used for the binder resin in view of fixing characteristic and anti-offset characteristic.

In the present invention, it is possible to mix one or more of homopolymers or copolymers of vinyl monomers as described above, polyester, polyurethane, epoxy resin, polyvinyl butyral, rosin, modified rosin, terpene resin, phenolic resin, aliphatic or alicyclic hydrocarbon resin, aromatic petroleum resin, etc., as desired, with the above-mentioned binder resin.

When two or more species of resins are mixed to provide a binder resin, it is preferred that the two or more species of resins have different molecular weights and are mixed in appropriate proportions.

The binder resin may preferably have a glass transition temperature of 45°–80° C., more preferably 55°–70° C., a number-average molecular weight (Mn) of 2,500–50,000, and a weight-average molecular weight (Mw) of 10,000–1,000,000.

The binder resin comprising the vinyl type polymer or copolymer may be obtained through polymerization, such as bulk polymerization, solution polymerization, suspension polymerization, or emulsion polymerization. When a carboxylic acid monomer and/or an acid anhydride monomer is used, the bulk polymerization or solution polymerization may preferably be used in view of the monomer properties.

An exemplary method thereof is as follows. A vinyl copolymer may be obtained by using an acidic monomer, such as a dicarboxylic acid, a dicarboxylic anhydride or a dicarboxylic acid monoester through bulk polymerization or solution polymerization. In the solution polymerization, a part of the dicarboxylic acid and dicarboxylic acid monoester units may be converted into anhydrides by appropriately controlling the condition for distilling off the solvent. The vinyl copolymer obtained by the bulk polymerization or suspension polymerization may be further converted into anhydride units by heat-treating it. It is also possible to esterify a part of the acid anhydride unit with a compound, such as an alcohol.

Reversely, it is also possible to cause ring-opening of the acid anhydride units of the thus obtained vinyl copolymer to convert a part thereof into dicarboxylic units.

On the other hand, it is also possible to convert a vinyl copolymer obtained by using a dicarboxylic monoester monomer into anhydride by heat-treatment or into dicarboxylic acid by hydrolyzation. The vinyl copolymer obtained through bulk polymerization or solution polymerization may be further dissolved in a polymerizable monomer, followed by suspension polymerization or emulsion polymerization to obtain a vinyl polymer or copolymer, during which a part of the acid anhydride units can be subjected to ring-opening to be converted into dicarboxylic acid units. At the time of the polymerization, another resin can be mixed in the polymerizable monomer. The resultant resin can be subjected to conversion into acid anhydride by heat treatment, ring-opening of acid anhydride by treatment with a weak alkaline water, or esterification with an alcohol.

Dicarboxylic acid and dicarboxylic anhydride monomers have a strong tendency of alternate polymerization, a vinyl copolymer containing functional groups, such as acid anhydride and dicarboxylic acid units in a random dispersed state may be produced in the following manner as a preferable method. A vinyl copolymer is formed from a dicarboxylic monoester monomer in solution polymerization, and the vinyl copolymer is dissolved in a monomer, followed by suspension polymerization to obtain a binder resin. In this process, all or a part of the dicarboxylic monoester units can be converted into anhydride units through de-alcoholic cyclization by controlling the condition for solvent removal after the solution polymerization. During the suspension polymerization, a part of the acid anhydride units may be hydrolyzed to cause ring-opening, thus providing dicarboxylic acid units.

The conversion into acid anhydride units in a polymer can be confirmed as a shift of infrared absorption of carbonyl toward a higher wave-number side than in the corresponding acid or ester. Thus, the formation or extinction of acid anhydride units may be conveniently confirmed by FT-IR (Fourier transform infrared spectroscopy).

The thus-obtained binder resin contains carboxyl group, acid anhydride group and dicarboxyl group uniformly dispersed therein, thus being able to provide a toner with satisfactory chargeability.

The polyester resin used in the present invention may preferably have a composition that it comprises 45–55 mol. % of alcohol component and 55–45 mol. % of acid component.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl alycol, 2-ethyl-1,3-hexanediol, hydrogenated bisphenol A, bisphenol derivatives represented by the following formula (3):

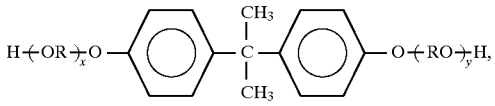

(3)

wherein R denotes an ethylene or propylene group, x and y are independently a positive integer with the proviso that the average of x+y is in the range of 2–10; diols represented by the following formula (4):

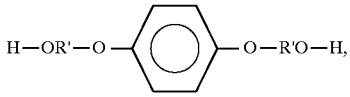

(4)

wherein R' denotes —$CH_2CH_2$—,

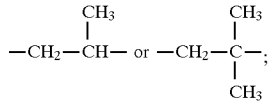

and polyhydric alcohols, such as glycerin, sorbitol and sorbitan.

Examples of the dibasic acid constituting at least 50 mol. % of the total acid component may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides; $C_6$–$C_{18}$ alkyl or alkenyl-substituted succinic acids, and their anhydrides; and unsaturated dicarboxylic acids, such as fumaric acid, maleic acid, citraconic acid and itaconic acid, and their anhydrides.

Examples of polybasic carboxylic acids having three or more functional groups may include: trimellitic acid, pyromellitic acid, benzophenonetetracarboxylic acid, and their anhydride.

An especially preferred class of alcohol components constituting the polyester resin is a bisphenol derivative represented by the above formula (3), and preferred examples of acid components may include dicarboxylic acids inclusive of phthalic acid. terephthalic acid, isophthalic acid and their anhydrides; succinic acid, n-dodecenylsuccinic acid, and their anhydrides, fumaric acid, maleic acid, and maleic anhydride; and tricarboxylic acids such as trimellitic acid and its anhydride.

The polyester resins obtained from these acid and alcohol components are preferred as the binder resin because they provide a toner for hot roller fixation showing good fixability and excellent anti-offset characteristic.

The polyester resin may preferably have an acid value of at most 90, more preferably at most 50, and an OH (hydroxyl) value of at most 50, more preferably at most 30. This is because the resultant toner is caused to have a chargeability remarkably affected by environmental conditions if the number of terminal groups is increased.

The polyester resin may preferably have a glass transition temperature of 50°–75° C., particularly 55°–65° C., a number-average molecular weight (Mn) of 1,500–50,000, particularly 2,000–20,000, and a weight-average molecular weight (Mw) of 6,000–100,000, particularly 10,000–90,000.

The toner for developing electrostatic images according to the present invention can further contain a negative or positive charge control agent, as desired, for further stabilizing the chargeability.

The charge control agent may preferably be used in an amount of 0.1–10 wt. parts, particularly 0.1–5 wt. parts, per 100 wt. parts of the binder resin.

Charge control agents known in the art at present may include the following.

Examples of the negative charge control agent for providing a negatively, chargeable toner may include: organic metal complexes or chelate compounds inclusive of monoazo metal complexes and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols.

Examples of the positive charge control agent for providing a positively chargeable toner may include: nigrosine, nigrosine derivatives, and quaternary ammonium salts.

In the present invention the addition effects of the particles comprising the double oxide (A) becomes more noticeable in the case of using the negatively chargeable toner.

When the toner of the present invention is formulated as a magnetic toner, the toner contains a magnetic material as a (magnetic) colorant.

Examples of the magnetic material contained in such a magnetic toner may include: iron oxides, such as magnetite, hematite, and ferrite; magnetic iron oxides containing another metal oxide; metals, such as Fe, Co and Ni, and alloys of these metals with other metals, such as Al, Co, Cu, Pb, Mg, Ni, Sn, Zn, Sb, Be, Bi, Cd, Ca, Mn, Se, Ti, W and V; and mixtures of the above.

Specific examples of the magnetic material may include: triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFel_2O_{19}$), magnesium iron oxide ($MgFe_2O_4$), manganese iron oxide ($MnFe_2O_4$), lanthanum iron oxide ($LaFeO_3$), powdery iron (Fe), powdery cobalt (Co), and powdery nickel (Ni). The above magnetic materials may be used singly or in mixture of two or more species. Particularly suitable magnetic material for the present invention is fine powder of triiron tetroxide or $\gamma$-diiron trioxide.

The magnetic material may have an average particle size of 0.1–2 $\mu$m. The magnetic material may preferably show magnetic properties when measured by application of 795.8 kA/m, inclusive of: a coercive force (Hc) of 1.6–12.0 kA/m, a saturation magnetization ($\sigma s$) of 50–200 $Am^2/kg$, particularly 50–100 $Am^2/kg$, and a residual magnetization ($\sigma s$) of 2–20 $Am^2/kg$.

The magnetic material may be contained in the toner in a proportion of 10–200 wt. parts, preferably 20–150 wt. parts, per 100 wt. parts of the binder resin.

The toner according to the present invention may optionally contain a non-magnetic colorant, inclusive of arbitrary pigments or dyes.

Examples of the pigment may include: carbon black, aniline black, acetylene black, Naphthol Yellow, Hansa Yellow, Rhodamine Lake, Alizarine Lake, red iron oxide. Phthalocyanine Blue, and Indanthrene Blue. It is preferred to use 0.1–20 wt. parts, particularly 1–10 wt. parts, of a pigment per 100 wt. parts of the resin. For similar purpose, there may also be used dyes, such as anthraquinone dyes, xanthene dyes, and methine dyes, which may preferably be used in an amount of 0.1–20 wt. parts, particularly 0.3–10 wt. parts, per 100 wt. parts of the binder resin.

In the present invention, it is also possible to incorporate one or two or more species of release agent, as desired within, toner particles.

Examples of the release agent may include:

aliphatic hydrocarbon waxes, such as low-molecular weight polyethylene, low-molecular weight polypropylene, microcrystalline wax, and paraffin wax, oxidation products of aliphatic hydrocarbon waxes, such as oxidized polyethylene wax, and block copolymers of these; waxes containing aliphatic esters as principal constituents, such as carnauba wax, sasol wax, montanic acid ester wax, and partially or totally deacidified aliphatic esters, such as deacidified carnauba wax. Further examples of the release agent may include: saturated linear aliphatic acids, such as palmitic acid, stearic acid, and montanic acid; unsaturated aliphatic acids, such as brassidic acid, eleostearic acid and parinaric acid; saturated alcohols, such as stearyl alcohol, arachidic alcohol, behenyl alcohol, carnaubyl alcohol, ceryl alcohol, and melissyl alcohol; long-chain alkyl alcohols; polyhydric alcohols, such as sorbitol; aliphatic acid amides, such as linoleylamide, oleylamide, and laurylamide; saturated aliphatic acid bisamides, such as methylene-bisstearylamide, ethylene-biscaprylamide, ethylene-bislaurylamide and hexamethylene-bisstearylamide; unsaturated aliphatic acid amides, such as ethylene-bisolerylamide, hexamethylene-bisoleylamide, N,N'-dioleyladipoylamide, and N,N'-dioleylsebacoylamide; aromatic bisamides, such as m-xylene-bisstearoylamide, and N,N'-distearylisophthalylamide; aliphatic acid metal salts (generally called metallic soap), such as calcium stearate, calcium laurate, zinc stearate, and magnesium stearate;

grafted waxes obtained by grafting aliphatic hydrocarbon waxes with vinyl monomers, such as styrene and acrylic acid; partially esterified products between aliphatic acids and polyhydric alcohols, such as behenic acid monoglyceride; and methyl ester compounds having hydroxyl group as obtained by hydrogenating vegetable fat and oil.

The release agent may preferably be used in an amount of 0.1–20 wt. parts, particularly 0.5–10 wt. parts, per 100 wt. parts of the binder resin.

The release agent may be uniformly dispersed in the binder resin by a method of mixing the release agent in a solution of the resin at an elevated temperature under stirring or melt-kneading the binder resin together with the release agent.

The toner of the present invention may further contain a flowability improver (flowability-improving agent). The flowability improver functions to improve the flowability of the toner when added to the toner. Examples thereof may include: powder of fluorine-containing resin, such as polyvinylidene fluoride fine powder and polytetrafluoroethylene fine powder; fine powdery silica such as wet-process silica and dry-process silica, and treated silica obtained by surface-treating such fine powdery silica with silane coupling agent, titanium coupling agent, silicone oil, etc.

A preferred class of the flowability-improving agent includes dry process silica or fumed silica obtained by vapor-phase oxidation of a silicon halide. For example, such silica powder can be produced according to the method utilizing pyrolytic oxidation of gaseous silicon tetrachloride in oxygen-hydrogen flame, and the basic reaction scheme may be represented as follows:

$$SiCl_4+2H_2+O_2 \rightarrow SiO_2+4HCl.$$

In the above preparation step, it is also possible to obtain complex fine powder of silica and other metal oxides by using other metal halide compounds such as aluminum chloride or titanium chloride together with silicon halide compounds. Such is also included in the fine silica powder to be used in the present invention.

It is preferred to use fine silica powder having an average primary particle size of 0.001–2 μm, particularly 0.002–0.2 μm.

Commercially available fine silica powder formed by vapor phase oxidation of a silicon halide to be used in the present invention include those sold under the trade names as shown below.

| | |
|---|---|
| AEROSIL | 130 |
| (Nippon Aerosil Co.) | 200 |
| | 300 |
| | 380 |
| | TT 600 |
| | MOX 170 |
| | MOX 80 |
| | COK 84 |
| Cab-O-Sil | M-5 |
| (Cabot Co.) | MS-7 |
| | MS-75 |
| | HS-5 |
| | EH-5 |
| Wacker HDK | N 20 |
| (WACKER-CHEMIE GMBH) | V 15 |
| | N 20E |
| | T 30 |
| | T 40 |
| D-C Fine Silica | |
| (Dow Corning Co.) | |
| Fransol | |
| (Fransil Co.) | |

It is further preferred to use treated silica fine powder obtained by subjecting the silica fine powder formed by vapor-phase oxidation of a silicon halide to a hydrophobicity-imparting treatment. It is particularly preferred to use treated silica fine powder having a hydrophobicity of 30–80 as measured by the methanol titration test.

Silica fine powder may be imparted with a hydrophobicity by chemically treating the powder with an organosilicone compound, etc., reactive with or physically adsorbed by the silica fine powder.

Example of such an organosilicone compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylcholrosilane, bromomethyldimethylchlorosilane, α-chloroethyltrichlorosilane, *-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-divinyltetramethyldisiloxane, and dimethylpolysiloxane having 2 to 12 siloxane units per molecule and containing each one hydroxyl group bonded to Si at the terminal units. These may be used alone or as a mixture of two or more compounds.

The flowability-improving agent used in the present invention may have a specific surface area of at least 30 $m^2/g$, preferably at least 50 $m^2/g$, as measured by the BET method according to nitrogen adsorption. The flowability-improving agent may be used in an amount of 0.01–8 wt. parts, preferably 0.1–4 wt. parts, per 100 wt. parts of the toner particles.

The toner for developing electrostatic images according to the present invention may be produced by sufficiently mixing a binder resin, a magnetic material, and optional additives, such as a colorant, a charge control agent and others, by means of a mixer such as a Henschel mixer or a ball mill; then melting and kneading the mixture by hot kneading means such as hot rollers, kneader and extruder to disperse or dissolve the resin and others; cooling and pulverizing the mixture; and subjecting the pulverized product to classification to recover toner particles.

Further, the toner particles are sufficiently blended with a flowability-improving agent and particles comprising the double oxide (A) (and the double oxide (B)) described above, such as a Henschel mixer to attach the additive to the toner particles, whereby a toner for developing electrostatic images according to the present invention is produced.

Various physical parameters referred to herein may be measured or determined according to the following methods.

(1) X-ray diffraction pattern

The X-ray diffraction pattern of particles comprising a double oxide may be obtained by using the following apparatus:

X-ray diffraction apparatus CN2013(available from Riaaku Denki K. K.)

Molding machine ("PX-700", available from Sarmonics K. K.)

A powdery sample is prevented by compression-pressing particles comparison a double oxide by means of the above molding machine. The molded sample is set in the above X-ray diffraction apparatus and subjected to measurement of X-ray intensity under the following conditions:

Target, Filter: Cu, Ti

Voltage, Current: 32.5 KV, 15 mA

Counter: Sc

Time Constant: 1 sec.

Divergence Slit: 1 deg.

Receiving Slit: 0.15 mm

Scatter Slit: 1 deg.

Angle Range: 60–20 deg.

From the thus-obtained peak intensities and corresponding Bragg angles (2θ), the structure of the sample can be identified.

(2) Double oxide content (within toner Particles)

The double oxide content in toner particles may be determined by using a calibration curve and the following apparatus:

Fluorescent X-ray spectrometer 3080 (available from Rigaku Denki K. K.)

Press Molding machine ("MAEKAWA Testing Machine", available from MFG Co., Ltd.)

(i) Preparation of calibration curve

Prescribed toner particles are blended with prescribed proportions (shown below) of double oxide particles in a coffee mill to prepare seven powdery samples for a calibration curve.

0 wt. %, 0.5 wt., %, 1.0 wt. %, 2.0 wt. %, 3.0 wt. %, 5.0 wt. %, 10.0 wt. %.

The thus-prepared 7 samples are press-molded by using the above press molding machine, respectively.

Based on 2θ table, a Kα peak angle (a) of a metallic element [M] within the double oxide particles is determined.

The respective samples for the calibration curve is set in a sample chamber of the above fluorescent X-ray spectrometer and the sample chamber is reduced in pressure to provide a vacuum state.

The calibration curve is prepared by obtaining X-ray intensities of the respective samples under the following conditions:

Measurement voltage (potential) and current: 50 kV, 50 mA

2θ angle (bragg angle): a

Crystal plate: LiF

Measurement time: 60 sec.

(ii) Quantification of double oxide within toner particles

A powdery sample is press molded and subjected to measurement of X-ray intensity in the same manner and under identical conditions as in the above (i). From the measured X-ray intensity, the double oxide content is determined by using the above-prepared calibration curve.

(3) Particle size distribution

The particle size distribution of a powdery sample is measured by means of a Coulter counter in the present invention, while it may be measured in various manners.

Coulter counter Multisizer Type-II (available from Coulter Electronics Inc.) is used as an instrument for measurement, to which an interface (available from Nikkaki K. K.) for providing a number-basis distribution, and a volume-basis distribution and a personal computer CX-1 (available from Canon K. K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3minutes by means of an ultrasonic disperser, and then subjected to measurement of particle size distribution by using the above-mentioned Coulter counter Multisizer Type-II with a 100 μm-aperture for a toner sample or a 13 μm-aperture for an inorganic fine powder sample to obtain a volume-basis distribution and a number-basis distribution. From the results of the volume-basis distribution and number-basis distribution, parameters characterizing the toner or inorganic fine powder of the present invention may be obtained. More specifically, the weight-basis average particle size ($D_4$) may be obtained from the volume-basis distribution.

(4) Acid value of vinyl-type resin

Qualitative and quantitative analysis of functional groups may be performed, for example, by application of infrared absorption spectrum, acid value measurement according to JIS K-0070 and acid value measurement by hydrolysis (total acid value measurement).

For example, in the infrared (IR) absorption, the presence of an acid anhydride fraction can be confirmed by an absorption peak in the neighborhood of 1780 $cm^{-1}$ attributable to the carbonyl group in the acid anhydride.

Herein, the IR-absorption spectrum peak refers to a peak which is recognizable after 16 times of integration by FT-IR having a resolution of 4 $cm^{-1}$. A commercially available example of the FT-IR apparatus is "FT-IR 1600" (available from Perkin-Elmer Corp.).

The measurement of acid value according to JIS K-0070 (hereinafter referred to as "JIS acid value") provides an acid value of an acid anhydride which is about 50% of the theoretical value (based on an assumption that a mol of an acid anhydride provides an acid value identical to the corresponding dicarboxylic acid).

On the other hand, the total acid value (A) measurement provides an acid value which is almost identical to the theoretical value. Accordingly, the acid value attributable to an acid anhydride group per g of a resin can be obtained in the following manner:

$$\text{total acid value } (B) = [\text{total acid value } (A) - \text{JIS acid value}] \times 2.$$

For example, in the case of preparing a vinyl-type copolymer composition used as a binder resin by using maleic acid monoester as an acid component through solution polymerization and suspension polymerization, the total acid value (B) of a vinyl-type copolymer formed in the solution polymerization can be calculated by measuring the JIS acid value and the total acid value (A) of the vinyl copolymer, and the amount (e.g., in terms of mol. %) of the acid anhydride formed during the polymerization step and the solvent removal step can be calculated from the total acid value and the vinyl monomer composition used in the solution polymerization. Further, the vinyl copolymer prepared in the solution polymerization is dissolved in monomers, such as styrene and butyl acrylate to prepare a monomer composition, which is then subjected to suspension polymerization. In this instance, a part of the acid anhydride groups causes ring-opening. The contents of dicarboxylic acid group, acid anhydride group and dicarboxylic acid monoester group of the vinyl copolymer composition after the suspension polymerization used as the binder resin can be calculated from the JIS acid value, total acid value (A) of the vinyl copolymer composition obtained by the suspension polymerization, the monomer composition for the suspension polymerization and amount of the vinyl copolymer prepared in the solution polymerization.

The total acid value (A) of a binder resin used herein is measured in the following manner. A sample resin in an amount of 2 g is dissolved in 30 ml of dioxane, and 10 ml of pyridine, 20 mg of dimethylaminopyridine and 3.5 ml of water are added thereto, followed by 4 hours of heat refluxing. After cooling, the resultant solution is titrated with 1/10 N-KOH solution in THF (tetrahydrofuran) to neutrality with phenolphthalein as the indicator to measure the acid value, which is a total acid value (A). Under the condition for the measurement of the total acid value (A), an acid anhydride group is hydrolyzed into dicarboxylic acid groups, but an acrylic ester group, a methacrylic ester group or a dicarboxylic monoester group is not hydrolyzed.

The above-mentioned 1/10 N-KOH solution in THF is prepared as follows. First, 1.5 g of KOH is dissolved in about 3 ml of water, and 200 ml of THF and 30 ml of water are added thereto, followed by stirring. After standing, a uniform clear solution is formed, if necessary, by adding a small amount of methanol if the solution is separated or by adding a small amount of water if the solution is turbid. Then, the factor of the 1/10 N-KOH/THF solution thus obtained is standardized by a 1/10 N-HCl standard solution.

The binder resin may have a total acid value (A) of 2–100 mgKOH/g, but it is preferred that the vinyl copolymer containing an acid component in the binder resin has a JIS acid value of below 100. If the JIS acid value is 100 or higher, the functional group such as carboxyl group and acid anhydride group are contained at a high density, so that it becomes difficult to obtain a good balance of chargeability and the dispersibility thereof is liable to be problematic even when it is used in a diluted form.

(5) Acid value of polyester resin

2–10 g of a sample resin is weighed in a 200 to 300 ml-Erlenmeyer flask, and about 50 ml of a methanol/toluene (=30/70) mixture solvent is added thereto to dissolve the resin. In case of poor solubility, a small amount of acetone may be added. The solution is titrated with an N/10 KOH/alcohol solution standardized in advance with the use of a 0.1% indicator mixture of bromothymol blue and phenolphthalein. The acid value is calculated from the consumption of the KOH/alcohol solution based on the following equation:

Acid value=vol. (ml) of KOH/alcohol×N15×56.1/sample weight, wherein N denotes the factor of the N/10 KOH/alcohol solution.

(6) Glass transition temperature Tg

Measurement of Tg of the binder resin may be performed in the following manner by using a differential scanning calorimeter (e.g., "DSC-7", available from Perkin-Elmer Corp.).

A sample in an amount of 5–20 mg, preferably about 10 mg, is accurately weighed.

The sample is placed on an aluminum pan and subjected to measurement in a temperature range of 30°–200° C. at a temperature-raising rate of 10° C./min in a normal temperature—normal humidity environment in parallel with a black aluminum pan as a reference.

In the course of temperature increase, a main absorption peak appears in the temperature region of 40°–100° C.

In this instance, the glass transition temperature is determined as a temperature of an intersection between a DSC curve and an intermediate line pressing between the base lines obtained before and after the appearance of the absorption peak.

Hereinbelow, the present invention will be described more specifically based on Production Examples and Example.

PRODUCTION EXAMPLE 1

1500 g of strontium carbonate and 600 g of silicon oxide were wet-blended for 8 hours in a ball mill, followed by filtration and drying. The mixture was molded under a pressure of 5 kg/cm$^2$ and calcined at 1300° C. for 8 hours.

The calcined product was mechanically pulverized to obtain strontium silicate fine powder (M-1) having a weight-average particle size ($D_4$) of 2.0 $\mu$m and a number-average particle size ($D_1$) of 1.0 $\mu$m.

The strontium silicate fine powder (M-1) was subjected to X-ray diffraction analysis to provide a X-ray diffraction pattern shown in FIG. 1, whereby it was confirmed that the powder (M-1) comprised $SrSiO_3$ (a=1, b=1, c=3 in the formula (1) for the double oxide (A) described above) and $Sr_2SiO_4$ (a=2, b=1, c=4).

Comparative Production Example 1

600 g of strontium carbonate and 320 g of titanium oxide were wet-blended for 8 hours in a ball mill, followed by filtration and drying. The mixture was molded under a pressure of 5 kg/cm$^2$ and calcined at 1100° C. for 8 hours.

The calcined product was mechanically pulverized to obtain strontium titanate fine powder (M-2) having a weight-average particle size ($D_4$) of 1.9 $\mu$m and a number-average particle size ($D_1$) of 1.1 $\mu$m.

Comparative Production Example 2

475 g of strontium titanate fine powder produced in the same manner as in Comparative Production Example 1 was blended with 25 g of commercially available silicone oxide fine powder (oil absorption =236 ml/100 g, apparent density =0.18 g/ml) in a coffee mill to prepare 5 wt. % silicone oxide-containing strontium titanate fine powder (M-3) having a $D_4$ of 1.9 $\mu$m and a $D_1$ of 1.1 $\mu$m.

EXAMPLE 1

Polyester resin (binder resin) 100 wt. parts
(Tg =60° C., acid value =20 mg/KOH,
OH value =30 mg/KOH, peak molecular
weight (Mp) =7,000, Mn =3,000,
Mw =55,000)
Magnetic iron oxide 90 wt. parts
(average particle size =0.15 $\mu$m;
Hc =9.2 kA/m, $\sigma s$ =83 Am$^2$/kg,
$\sigma r$ =11.5 Am$^2$/kg under magnetic
field of 795.8 kA/m)
Monoazo metal complex 1 wt. part
(negative charge control agent)
Low-molecular weight polyethylene 3 wt. parts
(release agent)

The above materials were pre-mixed by a Henschel mixer and melt-kneaded at 130° C. by a twin-screw extruder. After cooling, the kneaded product was coarsely crushed by a cutter mill and finely pulverized by a jet mill, followed by classification by a pneumatic classifier, to obtain negatively chargeable magnetic toner particles (X-A) having a weight-average particle size ($D_4$) of 6.5 $\mu$m.

To 100 wt. parts of the magnetic toner particles (X-A), 1.0 wt. part of hydrophobic silica (BET surface area of 200 m$^2$/g) and 3.0 wt. parts of particles comprising strontium silicate (M-1) were externally added and mixed in a Henschel mixer to obtain a magnetic toner (X-1).

The magnetic toner (X-1) was evaluated with respect to several evaluation items (Evaluations-1A to 3A) described below by using a digital copier obtained by remodeling a commercially available digital copier ("GP-55", mfd. by Canon K. K.) by replacing the hot fixation roller with a surf fixation sheet.

(Evaluation-1A)

400 g of the magnetic toner (X-1) was charged in a developer container (developing device) and left standing overnight (for at least 12 hours) in a normal temperature—normal humidity room (23° C., 60%). Thereafter, the magnetic toner (X-1) was subjected to image formation of 1000 sheets and then was subjected to measurement of image density.

Then, the developer container was detached from the digital copier and was left standing overnight (for 12 hours) in a high temperature—high humidity room (30° C., 80%). Immediately after the developer container was returned to the normal temperature—normal humidity room, the magnetic toner (X-1) was subjected to image formation of 20 sheets, followed by measurement of image density with respect to the first sheet in a similar manner. Evaluation was performed based on a difference in image density between the 1000-th sheet (the last sheet of the previous day) and the first sheet (after being left standing overnight) according to the following evaluation levels (ranks) A–F. The smaller density difference provided a better performance.

A: density difference of at most 0.02.
B: density difference of 0.03–0.05.
C: density difference of 0.06–0.10.
D: density difference of 0.11–0.15.
E: density difference of 0.16–0.20.
F: density difference of at least 0.21.

(Evaluation-2A)

400 g of the magnetic toner (X-1) was charged in a developer container and left standing overnight (for at least 12 hours) in a low temperature—low humidity room (15° C., 5%). By using an external driving unit, a gear of a developer-carrying member was rotated. From the start of the rotation, a toner application state at the surface of the developer-carrying member was observed for 10 minutes by eyes and evaluated according to the following evaluation levels A–F.

A: uniform over the entire surface (no ripple pattern was observed).

B: almost uniform but a slight ripple pattern was observed.

C: a ripple pattern was observed at a part of the surface.

D: a ripple pattern was observed at the entire surface.

E: a clear unevenness resulting from a ripple pattern was observed at a part of the surface.

F: a clear unevenness resulting from a ripple pattern was observed at the entire surface.

(Evaluation-3A)

400 g of the magnetic toner (X-1) was charged in a developer container and left standing overnight (for at least 12 hours) in a low temperature—low humidity room (15° C., 5%). Then, the magnetic toner (X-1) was subjected to image formation of 2000 sheets by using a chart for density evaluation to measure a fog (%) with respect to a solid white image at prescribed stages.

The fog (%) was determined by measuring reflectances of the solid white image and on unused paper by means of a reflectometer (available from Tokyo Denki K. K.) and calculating a difference in reflectance therebetween according to the following equation:

Fog (%)=(reflectance of unused paper (%))- (reflectance of solid white image (%))

The fog (%) was evaluated according to the following evaluation levels A–F.

A: fog of at least 0.1%.

B: fog of 0.1–0.5%.

C: fog of 0.5–1.0%.

D: fog of 1.0–1.5%.

E: fog of 1.5–2.0%.

F: fog of at least 2.0%.

The evaluation results are shown in Tables 1 and 2 appearing hereinafter.

EXAMPLE 2

A magnetic toner (X-2) was prepared and evaluated in the same manner as in Example 1 except that the addition amount of the double oxide (M-1) was changed to 0.03 wt. part.

The results are shown in Tables 1 and 2.

EXAMPLE 3

A magnetic toner (X-3) was prepared and evaluated in the same manner as in Example 1 except that the addition amount of the double oxide (M-1) was changed to 0.05 wt. part.

The results are shown in Tables 1 and 2.

EXAMPLE 4

A magnetic toner (X-4) was prepared and evaluated in the same manner as in Example 1 except that the addition amount of the double oxide (M-1) was changed to 0.10 wt. part.

The results are shown in Tables 1 and 2.

EXAMPLE 5

A magnetic toner (X-5) was prepared and evaluated in the same manner as in Example 1 except that the addition amount of the double oxide (M-1) was changed to 5.0 wt. parts.

The results are shown in Tables 1 and 2.

EXAMPLE 6

A magnetic toner (X-6) was prepared and evaluated in the same manner as in Example 1 except that the addition amount of the double oxide (M-1) was changed to 10.0 wt. parts.

The results are shown in Tables 1 and 2.

EXAMPLE 7

A magnetic toner (X-7) was prepared and evaluated in the same manner as in Example 1 except that the addition amount of the double oxide (M-1) was changed to 15.0 wt. parts.

The results are shown in Tables 1 and 2.

EXAMPLE 8

A magnetic toner (X-8) was prepared and evaluated in the same manner as in Example 1 except that the addition amount of the double oxide (M-1) was changed to 15.5 wt. parts.

The results are shown in Tables 1 and 2.

Comparative Example 1

A magnetic toner (Y-1) was prepared and evaluated in the same manner as in Example 1 except that the double oxide (M-1) was not used and the addition amount of the hydrophobic silica was changed to 5.0 wt. parts.

The results are shown in Tables 1 and 2.

Comparative Example 2

A magnetic toner (Y-2) was prepared and evaluated in the same manner as in Example 1 except that the double oxide (M-1) was not used.

The results are shown in Tables 1 and 2.

Comparative Examples 3 and 4

Magnetic toners (Y-3) and (Y-4) were prepared and evaluated in the same manner as in Example 1 except that the double oxide (M-1) was changed to the double oxides (M-2) and (M-3), respectively.

The results are shown in Tables 1 and 2.

TABLE 1

| | | Evaluation-1A | | | | | | Evaluation-3A | | | |
|---|---|---|---|---|---|---|---|---|---|---|---|
| Example No. | Toner No. | Initial | After 500 sheets | After 1000 sheets | After standing overnight | Density difference | Rank | Initial | After 500 sheets | After 1000 sheets | After 2000 sheets |
| Ex. | | | | | | | | | | | |
| 1 | X-1 | 1.49 | 1.47 | 1.48 | 1.46 | 0.02 | A | B | B | A | A |
| 2 | X-2 | 1.38 | 1.42 | 1.41 | 1.30 | 0.11 | D | B | A | A | A |
| 3 | X-3 | 1.40 | 1.41 | 1.42 | 1.32 | 0.10 | C | B | A | A | A |
| 4 | X-4 | 1.41 | 1.43 | 1.43 | 1.35 | 0.08 | C | B | A | A | A |
| 5 | X-5 | 1.50 | 1.48 | 1.49 | 1.47 | 0.02 | A | C | B | B | A |
| 6 | X-6 | 1.50 | 1.46 | 1.49 | 1.47 | 0.02 | A | C | C | C | C |
| 7 | X-7 | 1.50 | 1.50 | 1.48 | 1.46 | 0.02 | A | D | D | D | C |
| 8 | X-8 | 1.50 | 1.51 | 1.49 | 1.46 | 0.03 | B | D | D | D | D |
| Comp. Ex. | | | | | | | | | | | |
| 1 | Y-1 | 1.50 | 1.52 | 1.52 | 1.34 | 0.18 | E | F | E | E | E |
| 2 | Y-2 | 1.35 | 1.36 | 1.35 | 0.70 | 0.65 | F | C | C | C | D |
| 3 | Y-3 | 1.44 | 1.46 | 1.46 | 1.30 | 1.16 | E | B | A | A | A |
| 4 | Y-4 | 1.42 | 1.44 | 1.43 | 1.32 | 0.11 | D | D | C | C | C |

TABLE 2

| | | Evaluation-2A | | | | |
|---|---|---|---|---|---|---|
| Ex. No. | Toner No. | After 30 sec. | After 1 min. | After 3 min. | After 5 min. | After 10 min. |
| Ex. 1 | X-1 | A | A | A | A | B |
| Ex. 2 | X-2 | C | C | C | D | D |
| Ex. 3 | X-3 | C | C | C | C | D |
| Ex. 4 | X-4 | B | C | C | C | D |
| Ex. 5 | X-5 | A | A | A | A | B |
| Ex. 6 | X-6 | A | A | A | A | A |
| Ex. 7 | X-7 | A | A | A | A | A |
| Ex. 8 | X-8 | A | A | A | A | A |
| Comp. Ex. 1 | Y-1 | A | A | A | B | B |
| Comp. Ex. 2 | Y-2 | E | E | E | F | F |
| Comp. Ex. 3 | Y-3 | B | C | C | D | D |
| Comp. Ex. 4 | Y-4 | B | B | C | C | D |

PRODUCTION EXAMPLE 2

1500 g of strontium carbonate and 180 g of silicon oxide and 560 g of titanium oxide (molar ratio of (silicon oxide)/(titanium oxide) =30/70 were wet-blended for 8 hours in a ball mill, followed by filtration and drying. The mixture was molded under a pressure of 5 kg/cm$^2$ and calcined at 1300° C. for 8 hours.

The calcined product was mechanically pulverized to obtain fine powder (M-4), comprising strontium silicate ($SrSiO_3$) and strontium titanate ($SrTiO_3$) having a $D_4$ of 2.2 $\mu$m and a $D_1$ of 1.1 $\mu$m.

Figure 2:
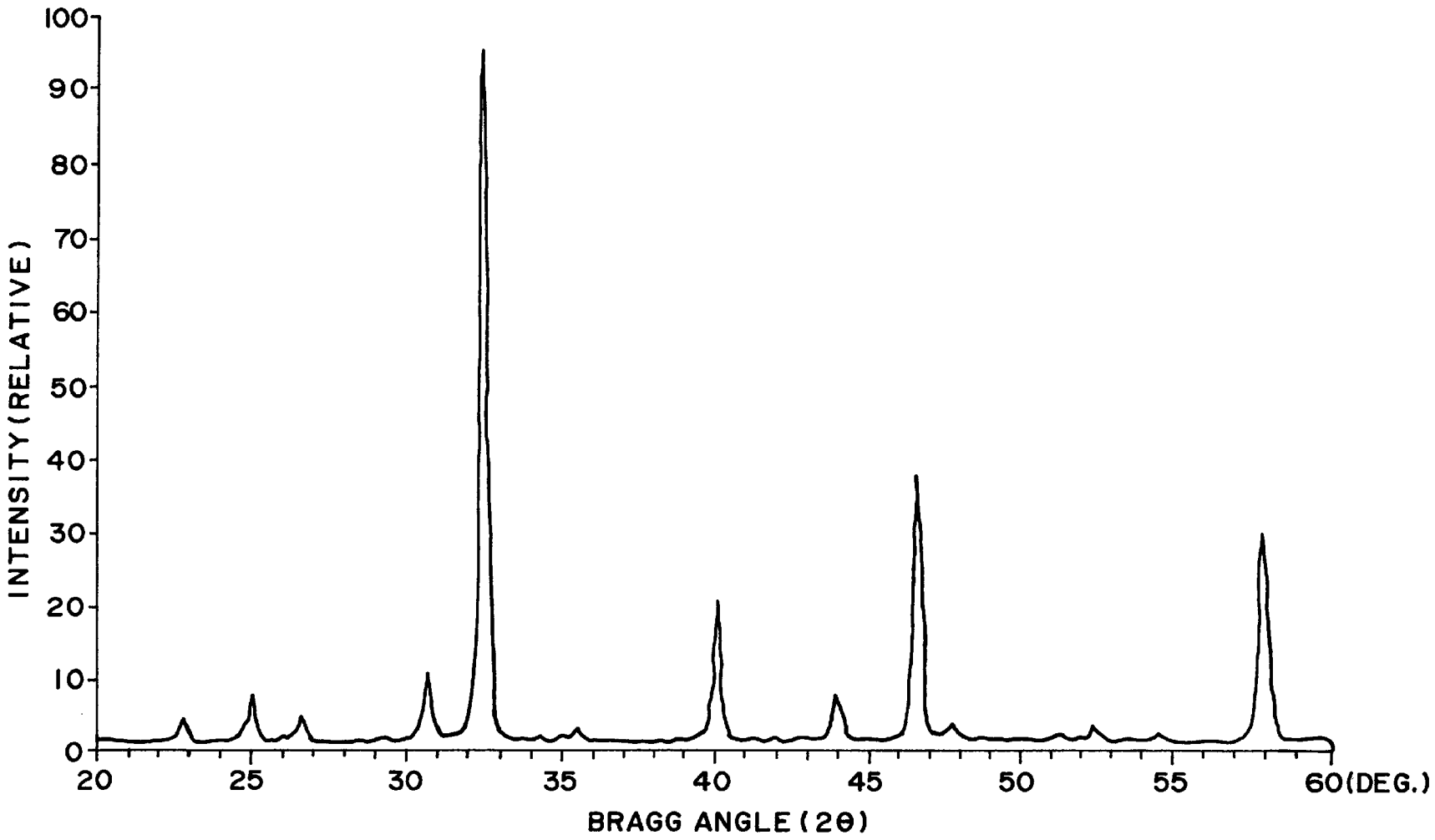
FIG. 2 is a graph showing an X-ray diffraction pattern of particles comprising strontium silicate and strontium titanate produced in Production Example 2 appearing hereinafter.

The fine powder (M-4) was subjected to X-ray diffraction analysis to provide a X-ray diffraction pattern shown in FIG. 2, whereby it was confirmed that the powder (M-4) comprised $SrSiO_3$ (a=1, b=1, c=3) and $SrTiO_3$ (d=1, e=1, f=3). Furthers the fine powder (M-4) was subjected to quantitative analysis of Si and Ti to confirm a ratio of Si:T.

Production Examples 3–9

Fine powders (M-5)–(M-11) each comprising strontium silicate ($SrSiO_3$) and strontium titanate ($SrTiO_3$) and having a $D_4$ of 1.8–2.3 $\mu$m and a $D_1$ of 0.9–1.2 $\mu$m were prepared in the same manner as in Production Example 2 except that the mixing molar ratio of (silicon oxide)/(titanium oxide) =30/70 was changed to 3/97, 5/95, 20/80, 70/30, 80/20, 95/5 and 97/3, respectively.

Comparative Production Example 4

600 g of strontium carbonate and 320 g of titanium oxide were wet-blended for 8 hours in a ball mill, followed by filtration and drying. The mixture was molded under a pressure of 5 kg/cm$^2$ and calcined at 1100° C. for 8 hours.

The calcined product was mechanically pulverized to obtain strontium titanate fine powder (M-12) having a $D_4$ of 1.9 $\mu$m and a $D_1$ of 1.1 $\mu$m.

Comparative Production Example 5

475 g of strontium titanate fine powder reduced in the same manner as in Comparative Production Example 4 was blended with 25 g of commercially available silicone oxide fine powder (oil absorption =236 m/100 g. apparent density =0.18 g/ml) in a coffee mill to prepare 5 wt. % silicone oxide-containing strontium titanate fine powder (M-13) having a $D_4$ of 1.9 $\mu$m and a $D_1$ of 1.1 $\mu$m.

Comparative Production Example 6

1500 g of cerium carbonate was calcined at 1300° C. for 10 hours in the presence of oxygen.

The calcined product was mechanically pulverized to obtain cerium oxide fine powder (M-14) having a $D_4$ of 2.0 μm and a $D_1$ of 1.1 μm.

Example 9

| | |
|---|---|
| Polyester resin (binder resin) (Tg = 60° C., acid value = 20 mg/KOH, OH value = 30 mg/KOH, (Mp = 7,000, Mn = 3,000, Mw = 55,000) | 100 wt. parts |
| Magnetic iron oxide (average particle size = 0.15 μm; Hc = 9.2 kA/m, σs = 83 $Am^2$/kg, σr = 11.5 $Am^2$/kg under magnetic field of 795.8 kA/m) | 90 wt. parts |
| Monoazo metal complex (negative charge control agent) | 1 wt. part |
| Low-molecular weight polyethylene (release agent) | 3 wt. parts |

The above materials were pre-mixed by a Henschel mixer and melt-kneaded at 130° C. by a twin-crew extruder. After cooling, the kneaded product as coarsely crushed by a cutter mill and finely pulverized by a jet mill, followed by classification by a pneumatic classifier, to obtain negatively chargeable magnetic toner particles (X-B) having a weight-average particle size ($D_4$) of 6.5 μm.

To 100 wt. parts of the magnetic toner particles (X-B), 1.0 wt. part of hydrophobic silica (BET surface area of 200 $m^2$/g) and 3.0 wt. parts of particles comprising strontium silicate and strontium titanate (M-4) were externally added and mixed in a Henschel mixer to obtain a magnetic toner (X-9).

The magnetic toner (X-9) was evaluated with respect to several evaluation items (Evaluations-1B to 3B) described below.

(Evaluation-1B)

1 kg of coarsely crushed toner particles (before fine pulverization by the Jet mill) for preparing the magnetic toner particles (X-B) produced in Example 9 were sieved out so as to have a particle size of below 60 mesh (aperture: 250 μm) and above 100 mesh (aperture: 150 μm), thus preparing a carrier (magnetic toner) for measurement of triboelectric charge.

Each of 0.50 g of the fine powder (double oxides or oxide) (M-4) to (M-14) prepared in Production Examples 2–9 and Comparative Production Examples 4–6, respectively, was weighed and placed in a 50 ml-plastic bottle (vessel) and thereafter was left standing overnight (for at least 12 hours) in a normal temperature—normal humidity room (23.5° C., 60%) while exposing the fine powder to the environment. After standing, 9.50 g of the above-prepared carrier was added to each of 0.50 g of the fine powders (M-4)–(M-14), respectively, contained in the respective plastic bottles. Thereafter, the respective plastic bottles were hermetically sealed up and subjected to shaking with hand for 2 minutes (about 120 strokes) to effect mixing of the carrier with each fine powder, whereby powdery samples for measurement were obtained.

Figure 4:
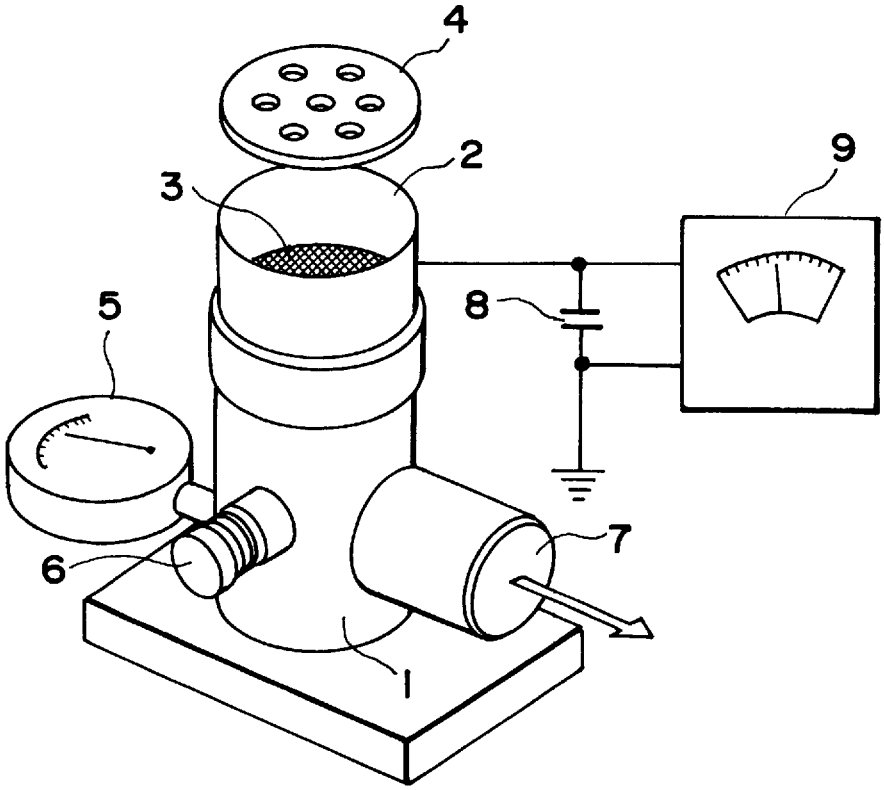
FIG. 4 is an illustration of an apparatus for measuring a triboelectric charge of a powdery sample.

Each of the thus prepared powdery samples (the shaken mixtures) was subjected to measurement of triboelectric charge by using a measuring apparatus as shown in FIG. 4 in the following manner.

Each of the shaken mixtures (powdery samples) was charged in a metal container 2 for measurement provided with 500-mesh electroconductive screen 3 (the screen size being changed to an appropriate size not passing the carrier) at the bottom as shown in FIG. 4 and covered with a metal lid 4. The total weight of the container 2 was weighed and denoted by $W_1$ (g). Then, an aspirator 1 composed of an insulating material at least with respect to a part contacting the container 2 was operated, and the fine powder in the container was removed by suction through a suction port 7 sufficiently (for about 2 min.) while controlling the pressure at a vacuum gauge 5 at 250 mmAq by adjusting an aspiration control valve 6. The reading at this time of a potential meter 9 connected to the container by the medium of a capacitor 8 having a capacitance C (μF) was denoted by V (volts.). The total weight of the container after the aspiration was measured and denoted by $W_2$ (g). Then, the triboelectric charge T (mC/kg) was calculated as: $T\ (mC/kg)=C\times V/(W_1-W_2)$.

The results are shown in Table 5 appearing hereinbelow. In Table 5, the larger (positive) value represented a better charge-imparting ability to the magnetic toner.

(Evaluation-2B)

500 g of the magnetic toner (X-9) was charged in a developer container and left standing overnight (for at least 12 hours) in a high temperature—high humidity room (30° C., 80%). Thereafter, the magnetic toner (X-9) was subjected to image formation of 300,000 sheets by using a remodeled digital copier ("NP6750", available from Canon K. K., drum heaterless system) to evaluate image flow (image dropout) and drum abrasion in the following manners, respectively.

Image flow

The image flow was evaluated by measuring an area of an image dropout portion at several stages in accordance with the following evaluation levels (ranks) A–F. The smaller area provided a better performance.

A: area of 0 $cm^2$.

B: area of 0.01–0.25 $cm^2$.

C: area of 0.26–2.0 $cm^2$.

D: area of 2.1–5.0 $cm^2$.

E: area of 5.1–10.0 $cm^2$.

F: area of at least 10.1 $cm^2$.

Drum abrasion

The drum abrasion was evaluated by measuring an abrasion amount (thickness) after image formation of 300,000 sheets in accordance with the following evaluation levels A–F. The smaller abrasion amount represented a better performance.

A: abrasion of 0–5.0 μm.

B: abrasion of 5.1–10.0 μm.

C: abrasion of 10.1–15.0 μm.

D: abrasion of 15.1–20.0 μm.

E: abrasion of 20.1–25.0 μm.

F: abrasion of at least 25.1 μm.

The results are shown in Table 3 appearing hereinafter.

(Evaluation-3B)

400 g of the magnetic toner (X-9) was charged in a developer container and left standing overnight (for at least 12 hours) in a normal temperature—normal humidity room (23° C., 60%). Thereafter, the magnetic toner (X-9) was subjected to image formation of 1000 sheets by using a digital copier ("GP-55", mfd. by Canon) remodeled to employ a drum heaterless system and replace a hot fixation roller with a surf fixation sheet, and then was subjected to measurement of image density.

Then, the developer container was detached from the digital copier and was left standing overnight (for 12 hours) in a high temperature—high humidity room (30° C., 80%). Immediately after the developer container was returned to the normal temperature—normal humidity room, the magnetic toner (X-9) was subjected to image formation of 20 sheets, followed by measurement of image density with respect to the first sheet in a similar manner. Evaluation was performed based on a difference in image density between the 1000-th sheet (the last sheet of the previous day) and the first sheet (after being left standing overnight) according to the following valuation levels (ranks) A–F. The smaller density difference provided a better performance.

A: density difference of at most 0.02.
B: density difference of 0.03–0.05.
C: density difference of 0.06–0.10.
D: density difference of 0.11–0.15
E: density difference of 0.16–0.20.
F: density difference of at least 0.21.

(Evaluation-4B)

400 g of the magnetic toner (X-9) was charged in a developer container and left standing overnight (for at least 12 hours) in a low temperature—low humidity room (15° C., 5%). Then, the magnetic toner (X-9) was subjected to image formation of 2000 sheets by using the digital copier used for Evaluation-3B to measure a fog (%) with respect to a solid white image at prescribed stages.

The fog (%) was determined by measuring reflectances of the solid white image and on unused paper by means of a reflectometer (available from Tokyo Denki K. K.) and calculating a difference in reflectance therebetween according to the following equation:

Fog (%)=(reflectance of unused paper (%))-(reflectance of solid white image (%))

The fog (%) was evaluated according to the following evaluation levels A–F.

A: fog of at least 0.1%.

B: fog of 0.1–0.5%.

C: fog of 0.5–1.0%.

D: fog of 1.0–1.5%.

E: fog of 1.5–2.0%.

F: fog of at least 2.0%.

The evaluation results of Evaluations-3B and 4B are shown in Table 4 appearing hereinafter.

EXAMPLES 10–15

Magnetic toners (X-10) to (X-15) were prepared and evaluated in the same manner as in Example 9 except that the addition amount of the double oxide (M-4) was changed to 0.03 wt. part, 0.05 wt. part, 0.10 wt. part, 5.0 wt. parts, 14.5 wt. parts and 15.5 wt. parts, respectively.

The results are shown in Tables 3–5.

EXAMPLES 16–22

Magnetic toners (X-16) to (X-22) were prepared and evaluated in the same manner as in Example 9 except that the double oxide (M-4) was changed to those (M-5) to (M-11) prepared in Production Examples 3–9, respectively.

The results are shown in Tables 3–5.

Comparative Example 5

A magnetic toner (Y-5) was prepared and evaluated in the same manner as in Example 9 except that the addition amount of the hydrophobic silica was changed to 5.0 wt. parts and the double oxide (M-4) was changed to the double oxide (M-12).

The results are shown in Tables 3–5.

Comparative Example 6

A magnetic toner (Y-6) was prepared and evaluated in the same manner as in Example 9 except that the double oxide (M-4) was not used.

The results are shown in Tables 3–5.

Comparative Examples 7–9

Magnetic toners (Y-7), (Y-8) and (Y-9) were prepared and evaluated in the same manner as in Example 9 except that the double oxide (M-4) was changed to the double oxides (M-12) and (M-13) and the oxide (M-14), respectively.

The results are shown in Tables 3–5 shown below.

TABLE 3

(Evaluation -2B)

| Example No. | Toner No. | Image flow After 50000 sheets | After 100000 sheets | After 200000 sheets | After 300000 sheets | Drum abrasion Abrasion (μm) | Rank |
|---|---|---|---|---|---|---|---|
| Ex. | | | | | | | |
| 9 | X-9 | A | A | A | A | 4.7 | A |
| 10 | X-10 | B | A | A | A | 3.2 | A |
| 11 | X-11 | B | C | C | D | 3.3 | A |
| 12 | X-12 | B | B | C | C | 3.2 | A |
| 13 | X-13 | A | A | A | A | 7.8 | B |
| 14 | X-14 | A | A | A | A | 14.6 | C |
| 15 | X-15 | A | A | A | A | 15 | C |
| 16 | X-16 | A | A | A | A | 6.7 | B |
| 17 | X-17 | A | A | A | A | 4.4 | A |
| 18 | X-18 | A | A | A | A | 4.5 | A |
| 19 | X-19 | A | A | A | A | 4.5 | A |
| 20 | X-20 | A | A | A | B | 4.3 | A |
| 21 | X-21 | A | A | A | B | 5 | A |
| 22 | X-22 | A | A | A | C | 4 | A |
| Comp. Ex. | | | | | | | |
| 5 | Y-5 | A | A | A | A | 11.5 | C |
| 6 | Y-6 | E | F | F | F | 4.1 | A |
| 7 | Y-7 | A | A | A | A | 8.1 | B |
| 8 | Y-8 | A | A | A | B | 7.8 | B |
| 9 | Y-9 | A | A | A | A | 25.1 | F |

TABLE 4

| Example No. | Toner No. | Evaluation-4B (fog) Initial | After 500 sheets | After 2000 sheets | Evaluation-3B (density difference) After 1000 sheets | After sanding overnight | Density difference | Rank |
|---|---|---|---|---|---|---|---|---|
| Ex. | | | | | | | | |
| 9 | X-9 | B | A | A | 1.47 | 1.45 | 0.02 | A |
| 10 | X-10 | B | B | B | 1.4 | 1.28 | 0.12 | D |
| 11 | X-11 | B | B | A | 1.41 | 1.31 | 0.1 | C |
| 12 | X-12 | B | B | A | 1.41 | 1.32 | 0.09 | C |
| 13 | X-13 | B | B | A | 1.49 | 1.47 | 0.02 | A |
| 14 | X-14 | C | B | B | 1.5 | 1.49 | 0.01 | A |
| 15 | X-15 | D | C | B | 1.5 | 1.48 | 0.02 | A |
| 16 | X-16 | B | A | A | 1.46 | 1.35 | 0.11 | D |
| 17 | X-17 | B | A | A | 1.47 | 1.38 | 0.09 | C |
| 18 | X-18 | B | A | A | 1.46 | 1.41 | 0.05 | B |
| 19 | X-19 | B | A | A | 1.46 | 1.45 | 0.01 | A |
| 20 | X-20 | B | A | A | 1.48 | 1.47 | 0.01 | A |
| 22 | X-21 | B | A | A | 1.47 | 1.44 | 0.03 | B |
| 23 | X-22 | B | B | A | 1.47 | 1.45 | 0.02 | A |
| Comp. Ex. | | | | | | | | |
| 5 | Y-5 | A | A | A | 1.48 | 1.26 | 0.22 | F |
| 6 | Y-6 | E | F | F | 1.33 | 0.62 | 0.71 | F |
| 7 | Y-7 | A | A | A | 1.45 | 1.24 | 0.21 | F |
| 8 | Y-8 | A | A | A | 1.44 | 1.28 | 0.16 | E |
| 9 | Y-9 | A | A | A | 1.41 | 1.2 | 0.21 | F |

TABLE 5

| (Evaluation-1B) Fine powder No. | Charge (mC/kg) |
|---|---|
| M-4 | +7.7 |
| M-5 | +3.9 |
| M-6 | +4.1 |
| M-7 | +7.2 |
| M-8 | +7.9 |
| M-9 | +7.9 |
| M-10 | +8 |
| M-11 | +8.1 |
| M-12 | +3.5 |
| M-13 | +3.3 |
| M-14 | +3.1 |

What is claimed is:

1. A toner for developing an electrostatic image, comprising:

toner particles comprising at least a binder resin and a colorant and particles comprising (i) a double oxide (A) represented by the following formula (1):

$$Sr_aSi_bO_c \quad (1),$$

and (ii) a double oxide (B) represented by the following formula (2):

$$M^2_dTi_eO_f \quad (2)$$

wherein $M^2$ is a metallic element selected from the group consisting of Sr, Mg, Zn, Co, Mn and Ce; a and d are each an integer of 1–9; b and e are each an integer of 1–9; and c and f are each an integer of 3–9.

2. The toner according to claim 1, wherein said double oxide (A) particles is externally added in an amount of 0.05–15 wt. parts to 100 wt. parts of said toner particles.

3. The toner according to claim 1, wherein said double oxide (A) comprises $SrSiO_3$.

4. The toner according to claim 1, wherein said double oxide (A) has a ratio (a/b) of 1/9 to 9.0.

5. The toner according to claim 1, wherein said double oxide (A) has a ratio (a/b) of 0.5 to 3.0.

6. The toner according to claim 1, wherein said double oxide (A) particles are produced by sintering.

7. The toner according to claim 1, wherein said double oxide (A) particles are externally added in an amount of 0.1–5.0 wt. parts to 100 wt. parts of said toner particles.

8. The toner according to claim 1, wherein said binder resin comprises a styrene-acrylic copolymer or a styrene-methacrylic copolymer.

9. The toner according to claim 1, wherein said binder resin comprises a polyester resin.

10. The toner according to claim 1, wherein said colorant comprises a magnetic material.

11. The toner according to claim 1, wherein said toner particles contain a negative charge control agent.

12. The toner according to claim 1, wherein said toner particles contain a positive charge control agent.

13. The toner according to claim 1, wherein said toner particles are externally mixed with silica fine powder.

14. The toner according to claim 1, wherein said toner particles have a weight-average particle size larger than that of said double oxide (A) particles.

15. The toner according to claim 14, wherein said toner particles have a weight-average particle size of 3–12 μm.

16. The toner according to claim 14, wherein said toner particles have a weight-average particle size of 3–9 μm.

17. The toner according to claim 1, wherein said particles comprising a double oxide (A) and a double oxide (B) is externally added in an amount of 0.05–15 wt. parts to 100 wt. parts of said toner particles.

18. The toner according to claim 1, wherein said double oxide (A) and said double oxide (B) are contained in a molar ratio of 5/95–95/5 in said particles.

19. The toner according to claim 1, wherein said double oxide (A) comprises $SrSiO_3$ and said double oxide (B) comprises $SrTiO_3$.

20. The toner according to claim 1, wherein said double oxide (B) has a ratio (d/e) of 1/9 to 9.0.

21. The toner according to claim 1, wherein said double oxide (B) has a ratio (d/e) of 0.5 to 3.0.

22. The toner according to claim 1, wherein said double oxide (A) and said double oxide (B) are contained in a molar ratio of 0.05–19.0 in said particles.

23. The toner according to claim 1, wherein said double oxide (A) and said double oxide (B) are contained in a molar ratio of 0.25–1.5 in said particles.

24. The toner according to claim 1, wherein said particles comprising a double oxide (A) and a double oxide (B) are produced by sintering.

25. The toner according to claim 1, wherein said particles comprising a double oxide (A) and a double oxide (B) are externally added in an amount of 0.1–5.0 wt. parts to 100 wt. parts of said toner particles.

26. The toner according to claim 1, wherein said toner particles have a weight-average particle size larger than that of said particles comprising a double oxide (A) and a double oxide (B).

27. The toner according to claim 26, wherein said toner particles have a weight-average particle size of 3–9 $\mu$m.

28. The toner according to claim 26, wherein said toner particles have a weight-average particles size of 3–9 $\mu$m.

* * * * *

UNITED STATES PATENT AND TRADEMARK OFFICE

CERTIFICATE OF CORRECTION

PATENT NO. : 5,858,597

DATED : January 12,1999

INVENTOR(S) : YUICHI MIZOH ET AL.

It is certified that error appears in the above-identified patent and that said Letters Patent is hereby corrected as shown below:

COLUMN 1

Line 16, "after" should read --after being--.
Line 50, "image the" should read --image, the--.

COLUMN 4

Line 25, "Contrary" should read --In contrast--.
Line 43, "a toner to" should read --to a toner--.
Line 54, "the toner to" should read --to the toner--.
Line 57, "fogs." should read --fog.--.
Line 62, "repeats" should read --repeats the cycle of--.

COLUMN 5

Line 29, "its" should read --their--.
Line 40, "performances," should read --performances And-.
Line 62, "exhibits" should read --exhibit--.

COLUMN 6

Line 10, "charging." should read --charging,--.
Line 46, "comprises" should read --comprise--.
Line 60, "comprises" should read --comprise--.

UNITED STATES PATENT AND TRADEMARK OFFICE

CERTIFICATE OF CORRECTION

PATENT NO. : 5,858,597

DATED : January 12,1999

INVENTOR(S) : YUICHI MIZOH ET AL.

It is certified that error appears in the above-identified patent and that said Letters Patent is hereby corrected as shown below:

COLUMN 7

Line 38, "has" should read --have--.
Line 47, "penumatic" should read --pneumatic--.

COLUMN 8

Line 8, "p-noctylstyrene" should read --p-n-octylstyrene--.
Line 53, "20" should be deleted.
Line 56, Close up right margin.
Line 57, Close up left margin.

COLUMN 9

Line 67, "water," should read --solution,--.

COLUMN 11

Line 6, "anhydride." should read --anhydrides--.
Line 41, "negatively," should read --negatively--.

COLUMN 12

Line 5, "($BaFel_2O_{19}$)," should read --($BaFe_{12}O_{19}$--.
Line 38, "within," should read --with--.

UNITED STATES PATENT AND TRADEMARK OFFICE

CERTIFICATE OF CORRECTION

PATENT NO. : 5,858,597

DATED : January 12,1999

INVENTOR(S) : YUICHI MIZOH ET AL.

It is certified that error appears in the above-identified patent and that said Letters Patent is hereby corrected as shown below:

COLUMN 14

Line 13, "benzyldimethylcholrosilane" should read --benzyldimethylchlorosilane-.
Line 22, "divinyltetramethyldisiloxane" should read --diphenyltetramethyldisiloxane-.
Line 45, "such as" should read --by using, for example,--.
Line 61, "comparison" should read -containing--.
Line 65, "KV" should read --kV--.

COLUMN 15

Line 38, "(bragg" should read --(Bragg--.

COLUMN 16

Line 34, "g" should read --gram--.

UNITED STATES PATENT AND TRADEMARK OFFICE

CERTIFICATE OF CORRECTION

PATENT NO. : 5,858,597

DATED : January 12,1999

INVENTOR(S) : YUICHI MIZOH ET AL.

It is certified that error appears in the above-identified patent and that said Letters Patent is hereby corrected as shown below:

COLUMN 17

Line 30, "mixture solvent" should read --solvent mixture--.
Line 38, "N15" should read --N--.
Line 58, "pressing" should read --passing--.
Line 63, "Examples and" should read --Examples which follow--.

COLUMN 18

Line 8, "a" should read --an--.
Line 27, "silicone" should read --silicon--.
Line 29, "silicone" should read --silicon--.

COLUMN 19

Line 37, "eyes" should read --eye--.

UNITED STATES PATENT AND TRADEMARK OFFICE

CERTIFICATE OF CORRECTION

PATENT NO. : 5,858,597

DATED : January 12,1999

INVENTOR(S) : YUICHI MIZOH ET AL.

It is certified that error appears in the above-identified patent and that said Letters Patent is hereby corrected as shown below:

COLUMN 22

Line 9, "a" should read --an--.
Line 12, "Furthers" should read --Further,--.
Line 59, "silicone" should read --silicon--.
Line 60, "g." should read --g,--.
Line 62, "silicone" should read --silicon--.

COLUMN 23

Line 8, "(Mp" should read --Mp-.
Line 20," twin-crew" should read --twin-screw--.
Line 21, "as" should read --was--.
Line 38, "Jet" should read --jet--.

COLUMNS 31-36

Columns 31-36 are misnumbered and should read --25-30--, respectively--.

UNITED STATES PATENT AND TRADEMARK OFFICE

CERTIFICATE OF CORRECTION

PATENT NO. : 5,858,597

DATED : January 12,1999

INVENTOR(S) : YUICHI MIZOH ET AL.

It is certified that error appears in the above-identified patent and that said Letters Patent is hereby corrected as shown below:

COLUMN 33

Line 3, "sanding" should read --standing--.
Example 22, "22" should read --21--.
Example 23, "23" should read --22--.
Line 64, "is" should read --are--.

COLUMN 34

Line 59, "is" should read --are--.

COLUMN 36

Line 11, "particles" should read --particle--.

Signed and Sealed this

Sixteenth Day of November, 1999

*Attest:*

Q. TODD DICKINSON

*Attesting Officer*

*Acting Commissioner of Patents and Trademarks*